US005144273A

United States Patent [19]

Hayden

[11] Patent Number: 5,144,273

[45] **Date of Patent: * Sep. 1, 1992**

[54] HIGH LIMIT THERMOSTAT APPARATUS

[75] Inventor: Kenneth L. Hayden, Bardstown, Ky.

[73] Assignee: Texas Instruments Incorporated, Dallas, Tex.

[ * ] Notice: The portion of the term of this patent subsequent to Sep. 24, 2008 has been disclaimed.

[21] Appl. No.: 731,186

[22] Filed: Jul. 15, 1991

[51] Int. Cl.[5] ..... H01H 37/04; H01H 37/52

[52] U.S. Cl. ..... 337/380; 337/135; 337/372

[58] Field of Search ..... 337/380, 381, 372, 147, 337/135

[56] References Cited

U.S. PATENT DOCUMENTS 5,051,717 9/1991 Hayden ..... 337/380

*Primary Examiner*—Harold Broome

*Attorney, Agent, or Firm*—Russell E. Baumann; Richard L. Donaldson; Rene' E. Grossman

[57] ABSTRACT

A high limit thermostat for gas furnace applications is shown having a molded base plate and an elongated housing formed integrally with the base plate which mounts a thermostat at a free end of the housing in order to be positioned within an air stream of a heat exchanger to sense temperature conditions of the air stream. An extended version is shown in which one end of a pair of elongated terminals are received in slots formed in the housing with the thermostat mounted on the opposites ends of the elongated terminals.

7 Claims, 4 Drawing Sheets

HIGH LIMIT THERMOSTAT APPARATUS

This application includes subject matter contained in coassigned, copending application, Ser. No. 07/630,677, filed Dec. 20, 1990.

This invention relates generally to thermostatic electric switches and more particularly such switches which are adapted to sense temperature conditions of air in a heat exchanger.

Bimetal helical coil type control switches having a coil extending into the air stream of a heat exchanger have been used for gas furnace high limit switches to sense high temperature conditions and to control a fan associated with the system. When electronically controlled timed delay for fan control came into use it became conventional to employ a small thermostat having a snap acting thermostatic disc disposed in the air stream. The thermostat, was in effect, suspended from a base plate by a pair of stilt terminals which were riveted respectively to quick connect terminals on the base plate and to the thermostat. This approach is effective to sense the temperature of the air stream however it suffers from several inherent problems including loose rivets either due to faulty riveting or loosening during life due to thermal expansion and contraction associated with heat and cool cycles. Loose rivets result in lack of electrical continuity through the rivet joints with concomitant operational problems of the control system. Another problem is the potential shorting out across uninsulated terminal ends due to misalignment in the heat exchanger causing the control system to see a constantly closed condition.

It is an object of the present invention to provide a high limit thermostatic control which obviates the above mentioned limitations of the prior art.

Yet another object of the invention is the provision of a control which is inexpensive to manufacture with fewer components than prior art devices and yet is reliable in operation.

Still another object is the provision of a thermostatic apparatus for gas furnace applications which is safer than prior art devices.

Briefly, in accordance with the invention an integrally formed, molded base plate and housing receives a pair of snap-in elongated control terminals in spaced apart relation within the housing. The control terminals are formed on one end with a quick connect end portion offset from the main body portion by a double ninety degree bend to limit motion in a first direction. The opposite end of the control terminals are welded to terminals of a thermostat mounted on a seat formed in the distal free end of the housing to limit motion of the control terminals in a second direction opposite the first direction thereby locking the thermostat in its seat with the housing providing total length insulation for the elongated control terminals.

According to a feature of the invention the thermostat may be mounted an extended distance from the base plate by forming first and second pairs of slots in the distal free end of the housing and mounting a first end of an elongated terminal in a respective pair of slots bottomed out against the end of the slots. In that position the elongated terminals are welded to the opposite end of the control terminals to lock the elongated terminals in their seat in the housing. The elongated terminals are inserted through insulating sleeves and the thermostat's terminals are welded to a second end of the elongated terminals to complete the assembly.

DESCRIPTION OF THE DRAWINGS

Other objects, advantages and details of the novel and improved high limit thermostat apparatus appear in the following detailed description of the preferred embodiment of the invention, the detailed description referring to the drawings in which:

With reference to FIGS. 1 and 2, a prior art high limit control is shown comprising a mounting plate 10, a pair of stilt terminals 12 each having an upper L-shaped portion 12*a*, a pair of L-shaped quick connect terminals 14 and a thermostat 16. Quick connect terminals 14 are attached to stilt terminals 12 on opposite sides of mounting plate 10 by means of rivets at 18 and in a similar manner, stilt terminals 12 are attached to the terminals of thermostat 16 by means of rivets 20. An insulating sleeve 22 is placed about each stilt terminal prior to the riveting operation. As noted above, this prior art control has inherent problems associated with it relating to loose rivets and the like and potential shorting. Further, it involves labor intensive assembly operations with many parts which add to the cost of the device.

With reference to FIGS. 3–9 a control 30 is shown comprising an elongated housing 32 integrally attached to base plate 34 as by molding. The housing and base plate may be formed of any suitable moldable electrically insulative material such as a thermoset or thermoplastic. Housing 32 is elongated with a thermostat mounting seat 36 formed in a cut out portion of the distal free end of the housing. Housing 32 is formed with side walls 38, 40 and front and rear walls 42, 44 respectively.

As seen in FIGS. 7 and 8 tapered ribs 46, 48 are centrally formed on the inside surface of side walls 38, 40 respectively and extend substantially along the entire length of housing 32 with the greater height formed toward the distal free end of the housing. A pair of spaced ribs 50, 52 are formed on the inside surface of front and rear walls 42, 44 respectively adjacent to the side walls and extend substantially from base plate 34 to a point near the center of the length of the housing to form channels for the control terminals effectively providing electrical isolation between the terminals as will be explained below.

Figure 9:
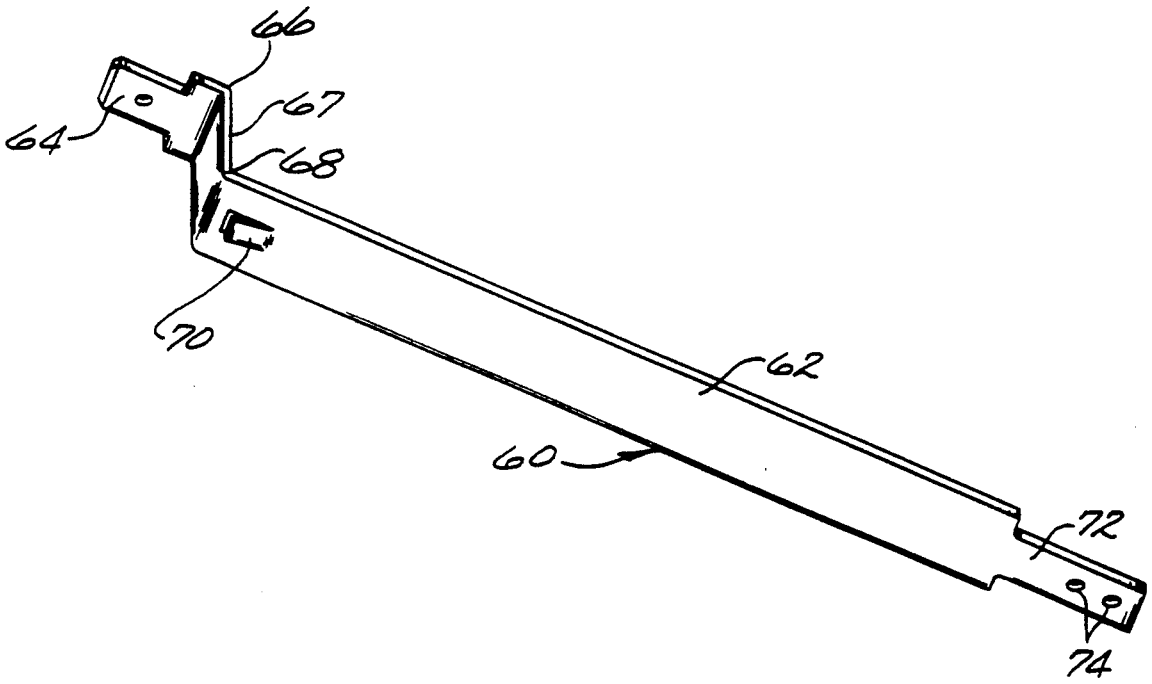
FIG. 9 is a perspective view of one of the elongated terminals used in the FIGS. 3–6 embodiment.

A pair of elongated control terminals 60, one of which is shown in FIG. 9, each comprises a central body portion 62 having one end 64 formed as a quick connect terminal blade portion offset from body portion 62 by double right angle bends 66, 68. A portion 67 extends laterally between the bends 66, 68 and is adapted to be received in recesses formed in the base plate to be discussed below. A tab 70 is preferably formed in body portion 62, adjacent bend 68, extending out of the plane in which portion 62 lies. The opposite end 72 of terminal 60 is formed with a thermostat attaching portion and preferably is provided with suitable welding projections 74.

Figure 6:
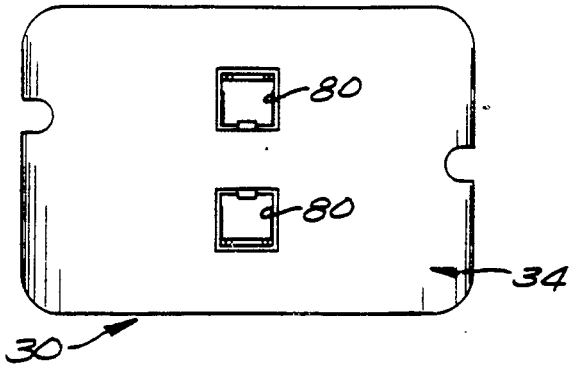
FIG. 6 is a top view of the FIG. 3 control.
Figure 6A:
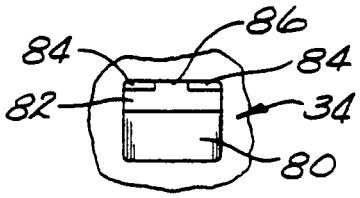
FIG. 6*a* is an enlarged top view of a portion of the base plate.
Figure 7:
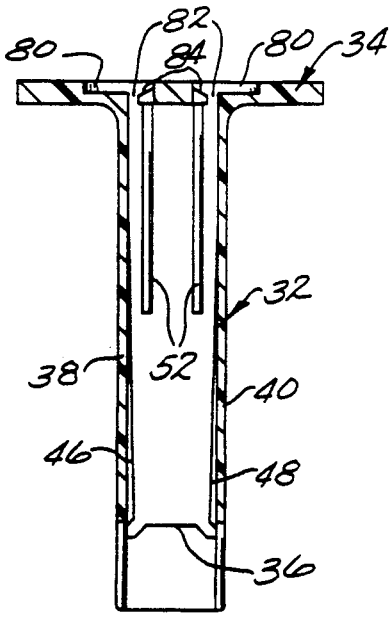
FIG. 7 is a view of the housing similar to FIG. 3 but in cross section.
Figure 8:
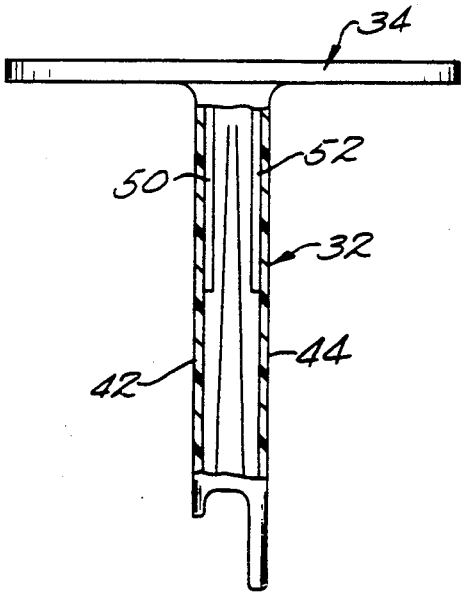
FIG. 8 is a view of the housing similar to FIG. 4 but partly in cross section.

Base plate 34, as best seen in FIG. 7 is formed with a pair of spaced recessed portions 80 with a pair of parallel extending slots 82 extending through the base plate into the interior of housing 32. A cammed shaped portion 84 is formed leading into each slot 82 with a centrally located cut out 86 (see FIG. 6*a*).

Figure 1:
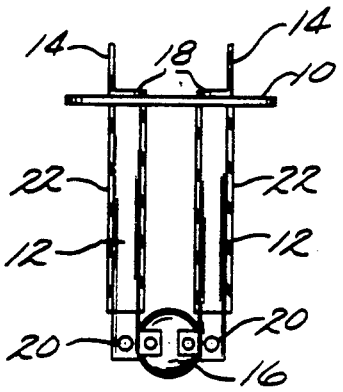
PRIOR ART Fig.1.
FIGS. 1 and 2 are front and side views respectively of a prior art high limit temperature control with insulating sleeves shown in cross section.
Figure 2:
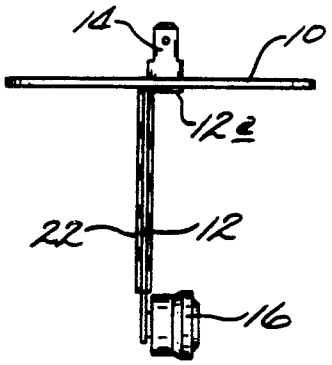
PRIOR ART Fig.2.
Figure 3:
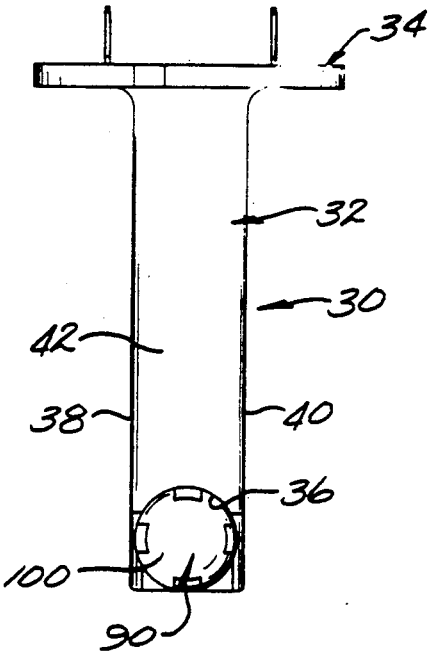
FIG. 3 is a front view of a high limit temperature control made in accordance with the invention.
Figure 4:
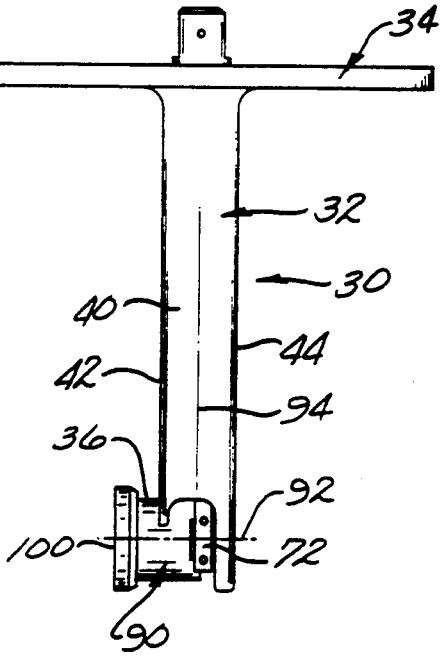
FIG. 4 is a side view of the FIG. 3 control.
Figure 5:
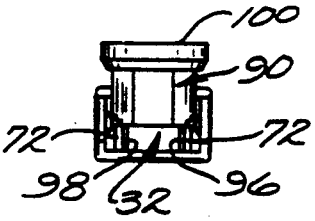
FIG. 5 is a bottom view of the FIG. 3 control with the base plate not shown for the purpose of simplicity.

The elongated control terminals are each inserted through a respective slot 82 until laterally extending offset portion 67 is seated in recess 80 with tab 70 received in cut out portion 86. The control terminals are received in the channels formed by ribs 50, 52 to maintain positive electrical isolation between the terminals. The end portions 72 are urged toward the center of the housing toward one another a slight amount by tapered ribs 46, 48 to facilitate welding to the terminals of thermostat 90. Thermostat 90 has a longitudinal axis 92 which, during assembly is inclined slightly, for example 5° relative to the longitudinal axis 94 of housing 32, with the terminals 96, 98 (FIG. 5) side of thermostat 90 being slightly closer to base plate 34 than the temperature sensing surface 100 side of the thermostat to, in effect, pull the thermostat tightly against seat 36 securely locking the thermostat in its seat. Stated in another way, thermostat 90 has a temperature sensing surface 100 lying in a plane with the terminals of the thermostat extending into housing 32 in a direction perpendicular to the plane and parallel to the longitudinal axis 92. The control terminals 60 extend from the mounting plate to the open end of the housing along longitudinal axis 94 which forms an angle of approximately 85° with the axis 92.

Side walls 38, 40 are cut away at their free distal end to facilitate welding portion 72 of terminals 60 to the thermostat terminals 96, 98. Back wall 44 provides suitable protection for the exposed terminal portions.

Figure 10:
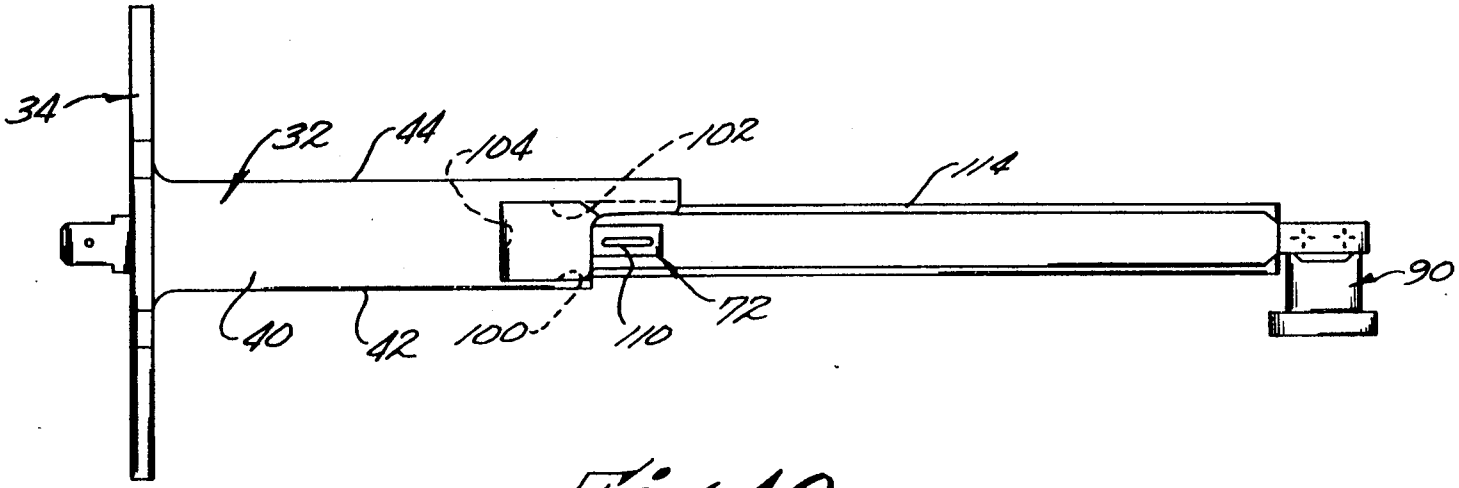
FIG. 10 is a side view of a high limit temperature control similar to the FIGS. 3, 4 control but with the thermostat mounted an extended distance from the base plate of the control.
Figure 11:
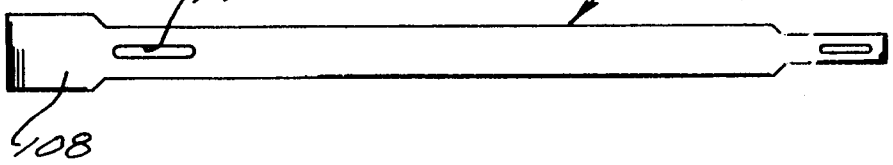
FIG. 11 is a side view of one of the elongated terminals used in the FIG. 10 control.

With reference to FIGS. 10 and 11 an embodiment is shown in which thermostat 90 is mounted an extended distance from base plate 34 while still being locked securely to the control assembly. First and second pairs of slots are formed spaced from one another in housing top and bottom walls 42, 44 respectively. The slots of each pair are aligned in facing relation with each other as shown by slots 100, 102 in FIG. 10 (the other pair of slots being hidden in that figure). The slots have an end surface 104 which serves as a seat for a respective elongated extension terminal 106. Terminals 106, one of which is shown in FIG. 11, are identical and are formed of suitable electrically conductive material, such as a cold rolled steel plated with nickel, and have a mounting portion 108 sized to closely fit within a respective pair of slots. Terminal 106 is bottomed out against end surface 104 and welded to end 72 of a respective control thermostat 60. Numeral 110 shows a weld rail on terminal 60 which is aligned with a slot 112 in elongated terminal 106. With the double right angle bends of control terminal 60 preventing movement in one direction the welding of terminal 106, bottomed out against end surface 104, to control terminal 60 locks the assembly together.

An insulating sleeve 114 of mylar or the like is placed over each of the elongated bodies of terminals 106 and the thermostat 90 is welded to the opposite second end 116 of terminals 106 at weld rail 118.

It should be understood that although a particular embodiment of the control has been described by way of illustrating the invention, the invention includes all the modifications and equivalents of the described embodiment falling within the scope of the appended claims.

I claim:

1. A fluid flow temperature control comprising an integral, elongated housing formed of electrically insulative material having a mounting plate with first and second spaced, parallel slots extending therethrough, the housing having front, rear and side walls extending from the mounting plate to an open distal end, first and second pairs of slots formed in the housing walls in communication with the open distal end and having an end surface, the slots of each pair being aligned in facing relation with each other, first and second control terminals having an elongated main body portion and each having a quick connect blade formed at a first end of the control terminal which is offset from the main body portion by a double ninety degree bend, the control terminals having a second end, each control terminal received in a respective slot of the mounting plate with the blade extending outwardly from the mounting plate and the main portion received in the housing extending along the side walls, first and second elongated extension terminals having first and second opposite ends, the first end of each extension terminal received in a respective pair of slots bottomed out against the end of their respective pair of slots and being welded to a respective second end of the control terminals, a thermostatic switch having first and second spaced terminals, the second end of the extension terminals being welded to the respective terminals of the thermostatic switch, the double ninety degree bend forming a laterally extending portion which extends parallel and contiguous to the mounting panel for a selected distance whereby the extension terminals are held in place bottomed out against the end of their respective pair slots by the laterally extending portions which extend parallel to the mounting panel without the use of any fasteners.

2. A fluid flow temperature control according to claim 1 further including a sleeve of electrically insulative material disposed on each extension terminal intermediate their ends.

3. A fluid flow temperature control according to claim 1 in which the mounting plate is formed with recessed portions which communicate with the first and second slots and the laterally extending portions are received in the respective recessed portions.

4. A fluid flow temperature control according to claim 3 in which a cam surface is formed on at least one side of each slot to facilitate guidance of the control terminals during assembly of the control.

5. A fluid flow temperature control according to claim 4 in which a portion of each cam surface is cut away and the control terminal is formed with a tab which is bent out of the main body portion, the tab being received in a respective cut away portion of the cam surface.

6. A fluid flow temperature control according to claim 1 in which the housing has a longitudinal axis and in which longitudinally extending tapered ribs are formed on the internal surfaces of the walls of the housing to bias the control terminals toward the center of the housing.

7. A fluid flow temperature control according to claim 1 in which the housing has a longitudinal axis and in which a pair of longitudinally extending ribs are formed adjacent the sides of the front and the rear walls to provide channels for the control terminals thereby providing positive electrical isolation between the control terminals.

* * * * *